United States Patent [19]

Pugh

[11] 4,081,876

[45] Apr. 4, 1978

[54] TOOTHBRUSHES

[75] Inventor: Brinley Roy Pugh, Tolworth, England

[73] Assignee: Lever Brothers Company, New York, N.Y.

[21] Appl. No.: 742,607

[22] Filed: Nov. 17, 1976

[30] Foreign Application Priority Data

Nov. 21, 1975 United Kingdom ..... 48001/75

[51] Int. Cl.[2] ..... A46B 9/04

[52] U.S. Cl. ..... 15/167 R

[58] Field of Search ..... 15/167, 110, 106; D4/24, 25, 31, 36

[56] References Cited

U.S. PATENT DOCUMENTS

| | | | |
|---|---|---|---|
| D. 187,976 | 5/1960 | Farber | D4/25 |
| 835,709 | 11/1906 | Miller | 15/167 R |

FOREIGN PATENT DOCUMENTS

| | | | |
|---|---|---|---|
| 683,311 | 2/1930 | France | 15/167 R |

*Primary Examiner*—Peter Feldman

*Attorney, Agent, or Firm*—James J. Farrell; Kenneth F. Dusyn; Melvin H. Kurtz

[57] ABSTRACT

A toothbrush comprising at least two adjacent rows of filaments of which in one row the filaments are upright and in the other the filaments are inclined. During longitudinal brushing the inclined filaments become more effective by flexing to the upright, and during lateral brushing the inclined filaments support the adjacent upright filaments against undue flexure.

6 Claims, 4 Drawing Figures

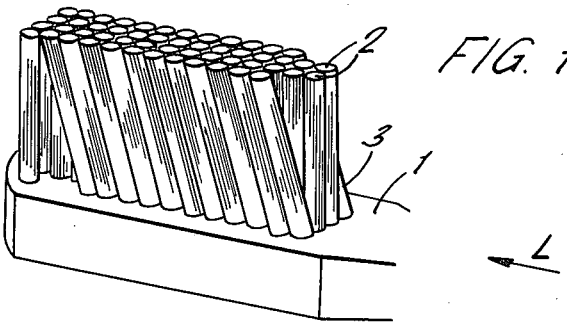
FIG. 1.
FIG. 2.
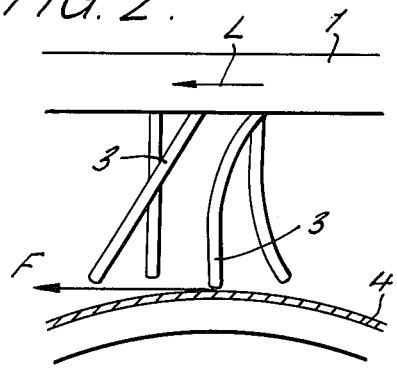
FIG. 3.
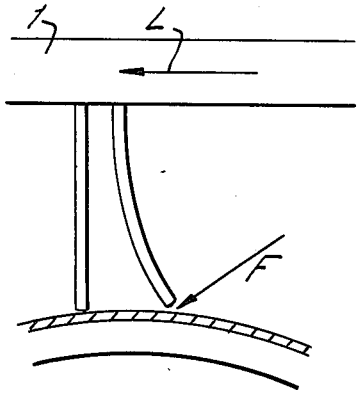
FIG. 4.
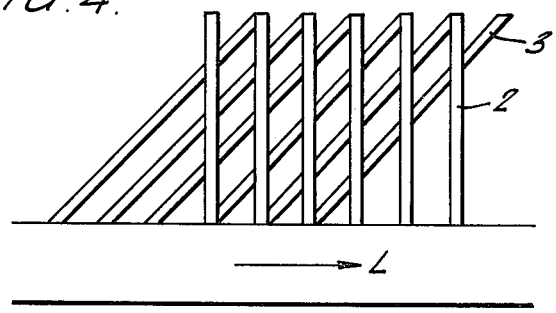

TOOTHBRUSHES

The present relates to toothbrushes.

Periodontal disease is strongly correlated with the presence of bracterial plaque in the mouth. Good hygiene care is essential to prevent and control this, and to this end the toothbrush is the most widely used dental aid. Thus the toothbrush should be capable of reaching into and removing dental plaque from the inter-dental areas and also from the gingival margins.

Various brushing methods can be indentified, but none is recommended above all others by dentists; and in practice methods used differ depending on manual dexterity and personal perference with the aim of removing plaque as effectively as possible. Thus, with the variety of methods possible, the toothbrush must be designed to be effective irrespective of specific brushing techniques employed.

It is recognised that vigorous use of a hard toothbrush can result in permanent injury to the gums and teeth, and that with a soft filament brush the filaments are less effective and rapidly become permanently deformed due to the pressures exerted during use.

There is therefore a requirement for a toothbrush whose structure enables a relatively soft filament to be used more effectively without unduly reducing the resistance to wear and deformation.

Thus, an improved brush should at least satisfy the two requirements of firstly being effective whatever brushing technique is used and of secondly relying on an effective use of soft, or not unduly hard, filaments.

Accordingly the invention provides a toothbrush including at least two adjacent longitudinal rows of filaments in which in one row the filaments are upright or perpendicular to said brushhead and in the other the filaments, while substantially lying in an upright or perpendicular longitudinal plane, are inclined to the upright.

Preferably there will be four such rows in which the inner two rows are upright and the outer two are inclined. The converse, with the outer rows upright and the inner rows inclined is also possible.

Preferably most of the filaments are inclined in the same direction, for example the direction away from the handle.

With such an arrangement two immediate advantages are obtained. When brushing transversely to the longitudinal (or handle) direction the inclined filaments provide support to prevent overflexing of the upright filaments. Whereas when brushing longitudinally in the direction of inclination of the inclined filaments, the effect of brushing is to force these inclined brush filaments to a more upright position. The restorative force of reaction acts in such a direction as to lift plaque from the dental surface more effectively. Furthermore in this condition the filaments increase in height during the flexure and can therefore penetrate more efffectively into the interdental and gingival regions.

A further advantage is that in use the brush gives the feeling to the user of a greater stiffness than would be anticipated in a conventional brush with filaments of similar diameter and length. In practice therefore a brush can be used with fine diameter filaments which will therefore not lacerate the soft gingival tissues, and such a brush becomes acceptable to the consumer.

With such a brush other known criteria should be used, for example the tufts should form a closely packed array and filaments be chosen to produce the desired textural stiffness.

Thus, said brushes can be constructed using nylon, or other synthetic filaments whose diameters range from 180 to 350 micro meters and whose length ranges from 10 to 14 mm. Preferred brushes contain filaments having filaments 200 – 250 micro meters in diameter and 10 – 14 mm in length, and these may be all of one nominal stiffness, or different stiffness groups (e.g. dual texture) may be mixed.

Preferably the ends of the filaments are finished to a constant height (flat upper surface) but with changes of filament stiffness it is possible to use contoured surfaces brush heads (either in the overall upper surface or for individual tufts).

An embodiment of the invention will now be described by way of an example with reference to the accompanying drawings in which:

FIG. 1 is a perspective of a new brush head;

FIG. 2 shows longitudinal flexing of filaments in a new brush head;

FIG. 3 shows similar flexing in a conventional brush; and

FIG. 4 shows a side elevation of the new brush head.

The brush comprises a handle 1 containing two inner rows of tufts of filaments 2 which are anchored vertically. The outer rows 3 comprise tufts of filaments which are inclined at about 20° in a forward direction away from the brush handle.

The tufts consist of filaments having diameters approximately 200 micro meters and 12 mm in length. The tufts are packed closely together (separation 2.0 to 2.5 mm centre to centre).

The external rectangular appearance of the brush is maintained by replacing some inclined tufts by vertically anchored (i.e. upright) tufts in the tip of the head. Also, a symmetrical tuft spacing is used. The tips of the filaments are finished to a constant height, so that the inclined filaments are in fact slightly longer than the upright filaments.

Alternative designs are possible in which the outer tufts are angled in the opposite direction, or one outer row inclined forwards and one backwards, or the positions of the upright and inclined rows are reversed.

In construction, holes in the brush head to take the inclined tufts of filaments need to have a similar inclination. Also, the tufts or filaments should be inserted into these holes by use of a tufting machine modified to provide the correct angled direction of insertion.

The filaments (both upright and inclined) can have their tips polished in conventional fashion and the ends of the tufts or groups of tufts can be profiled if desired.

Reference to FIG. 2 and 3 shows the resultant brushing force F on a tooth 4, when brushing in the longitudinal direction L away from the handle. In the FIG. 2 example the inclined filament 3 is flexed into a position where the direction of the resultant force F is most effective for plaque removal, while in FIG. 3 upright filaments are flexed to a position where the direction is less favourable.

Further reference to FIG. 2 shows that the inclined filaments 3 are flexed into a position where they are proud of the overall filament tip surface and can therefore reach more easily into crevices. In practice 20° inclined tufts increase in height by about 5% during such flexure while the upright tufts correspondingly decrease, resulting in about 10% effective increase overall.

Reference to FIG. 4 shows a side elevation of the brush head from which it can be seen that when brushing takes place laterally to the handle, each row is supported against undue flexure by the row behind it.

What is claimed is:

1. A toothbrush having a longitudinally aligned handle and brushhead and within the brushhead four parallel longitudinal rows of filaments, of which the filaments in two rows extend perpendicular to said brushhead and the filaments in the other two rows, while substantially lying in longitudinal planes perpendicular to said brushhead, are inclined in the same longitudinal direction and relative to said perpendicular filaments and in which each row of filaments lies adjacent a row whose filaments are inclined relative to the filaments in that row.

2. A toothbrush according to claim 1 comprising four rows of filaments in which the two inner rows are perpendicular to said brushhead and the two outer rows are inclined to the perpendicular to said brushhead.

3. A toothbrush according to claim 2 in which the outer rows are inclined away from the handle.

4. A toothbrush according to claim 3 in which in each outer inclined row a tuft of filaments perpendicular to said brushhead is included at the end farthest from the handle.

5. A toothbrush according to claim 1 in which the surface is finished to a constant height.

6. A toothbrush according to claim 1 in which the angle of inclination of the inclined filaments is substantially 20°.

* * * * *